United States Patent [19]

Sprey

[11] 4,146,780

[45] Mar. 27, 1979

[54] ANTIAIRCRAFT WEAPONS SYSTEM FIRE CONTROL APPARATUS

[75] Inventor: Pierre M. Sprey, Glenn Dale, Md.

[73] Assignee: ARES, Inc., Port Clinton, Ohio

[21] Appl. No.: 751,654

[22] Filed: Dec. 17, 1976

[51] Int. Cl.[2] ..... G06F 15/58; F41G 5/22

[52] U.S. Cl. ..... 235/412; 89/41 AA; 364/423; 364/571

[58] Field of Search ..... 89/41 AA, 41 L, 41 R, 89/41 SW; 235/404, 411, 412, 413

[56] References Cited

U.S. PATENT DOCUMENTS

| | | | |
|---|---|---|---|
| 3,135,053 | 6/1964 | Newman et al. | 89/41 SW |
| 3,260,478 | 7/1966 | Welti | 235/61.5 R |
| 3,290,992 | 12/1966 | Blomqvist | 89/41 SW |
| 3,309,963 | 3/1967 | Salomonsson | 235/61.5 S |
| 3,339,457 | 9/1967 | Pun | 235/61.5 R |
| 3,727,514 | 4/1973 | Maxime et al. | 89/41 E |
| 3,739,153 | 6/1973 | Kendy | 235/61.5 E |
| 3,798,420 | 3/1974 | Kaaz | 235/61.5 E |
| 3,848,509 | 11/1974 | Corn | 89/41 AA |
| 4,004,729 | 1/1977 | Rawicz et al. | 235/61.5 E |

*Primary Examiner*—Felix D. Gruber

*Attorney, Agent, or Firm*—Allan R. Fowler

[57] ABSTRACT

Fire control apparatus for an antiaircraft weapons system includes manual means for inputting both estimated roll angles and load (g) factors of a maneuvering target aircraft into a fire control computer. In response to other signals received from conventional target tracking and ranging means, the computer first calculates linearly projected future positions of the target aircraft. Corrections, which may be curvilinear, to these projected positions are then calculated from the inputed estimates of aircraft roll angle and load factor. A fire control commander selectively actuates manual controls to cause the fire control computer to combine this correction with the linearly calculated future positions, a substantially more accurate projection of aircraft-gun projectile intercept positions being thereby provided. Control signals corresponding to these new intercept positions are transmitted from the computer to conventional gun laying means to cause the gun to be aimed at the intercept positions. An illustrative example describing addition of the maneuvering corrections to a preexisting fire control system is included.

14 Claims, 8 Drawing Figures

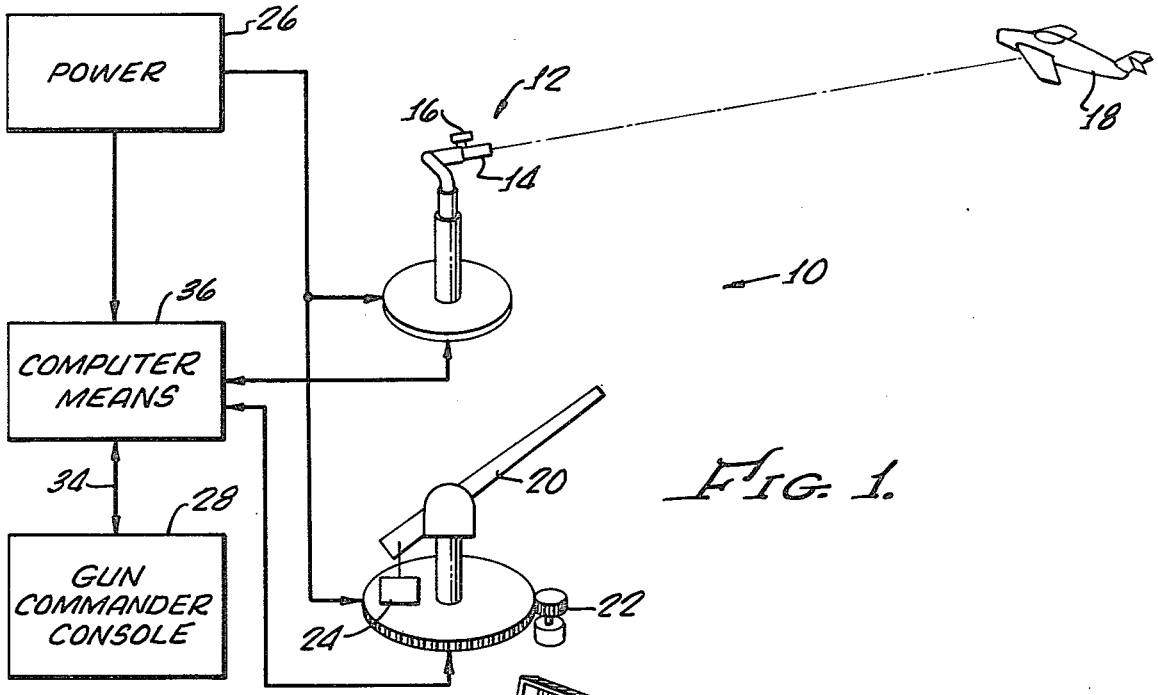
FIG. 1.
FIG. 2.
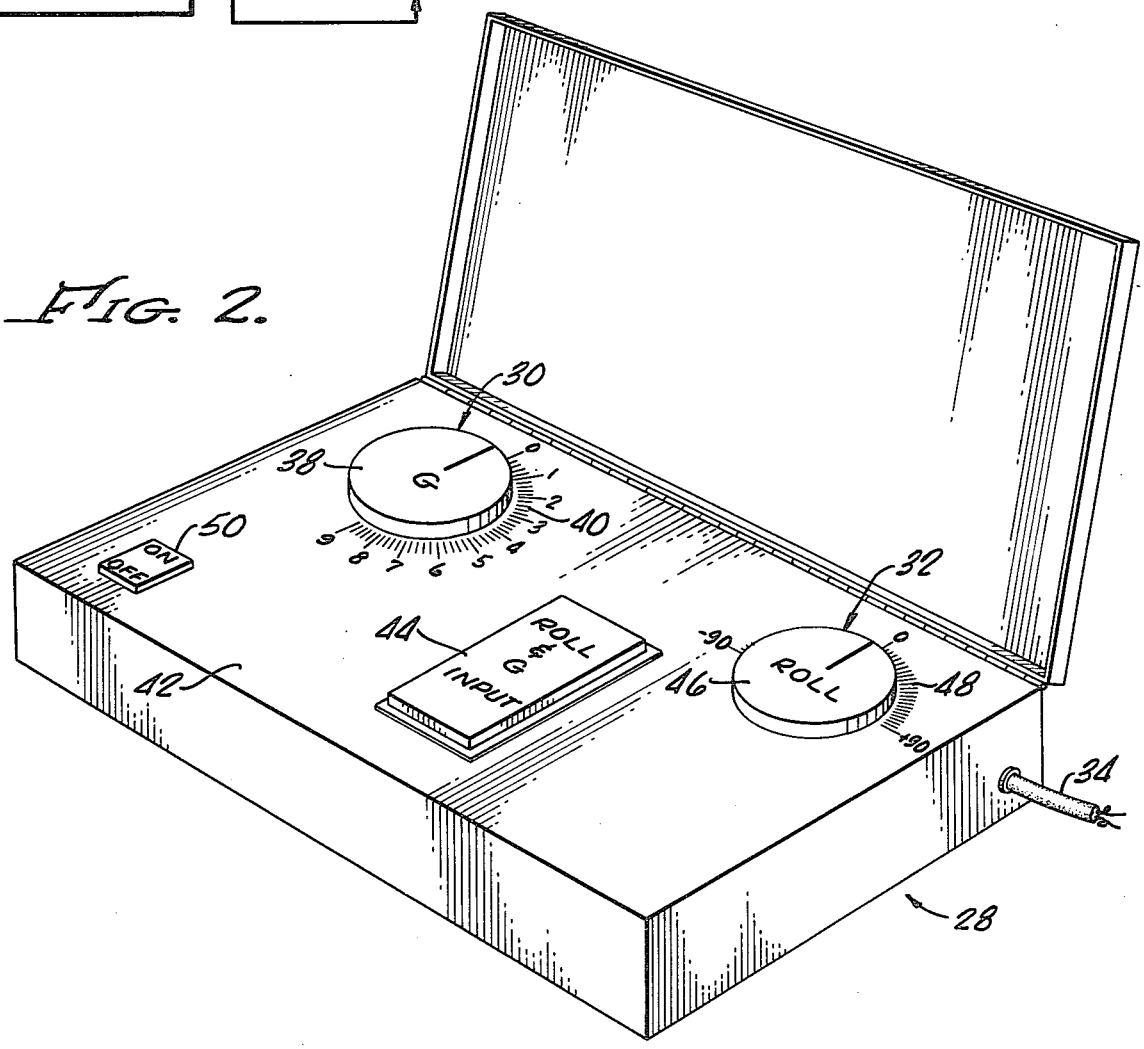

FIG. 4.
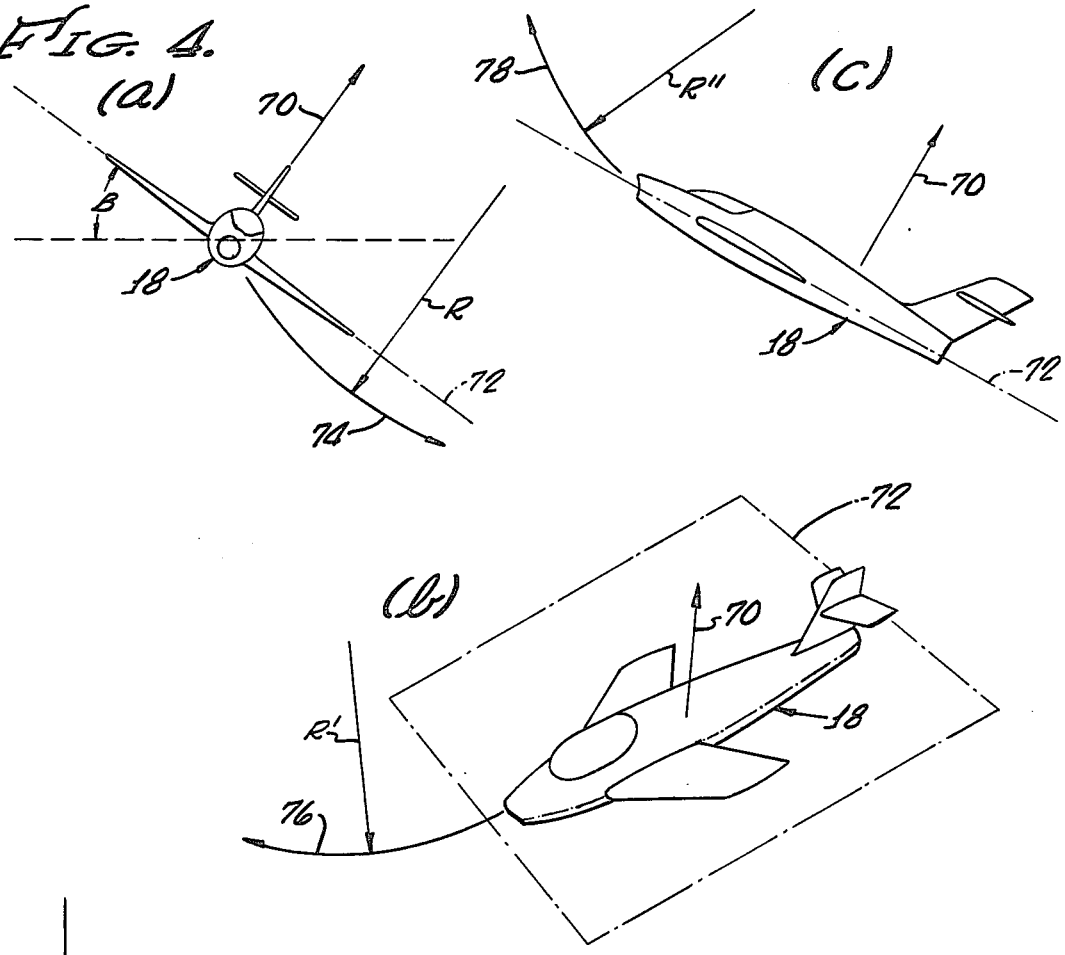
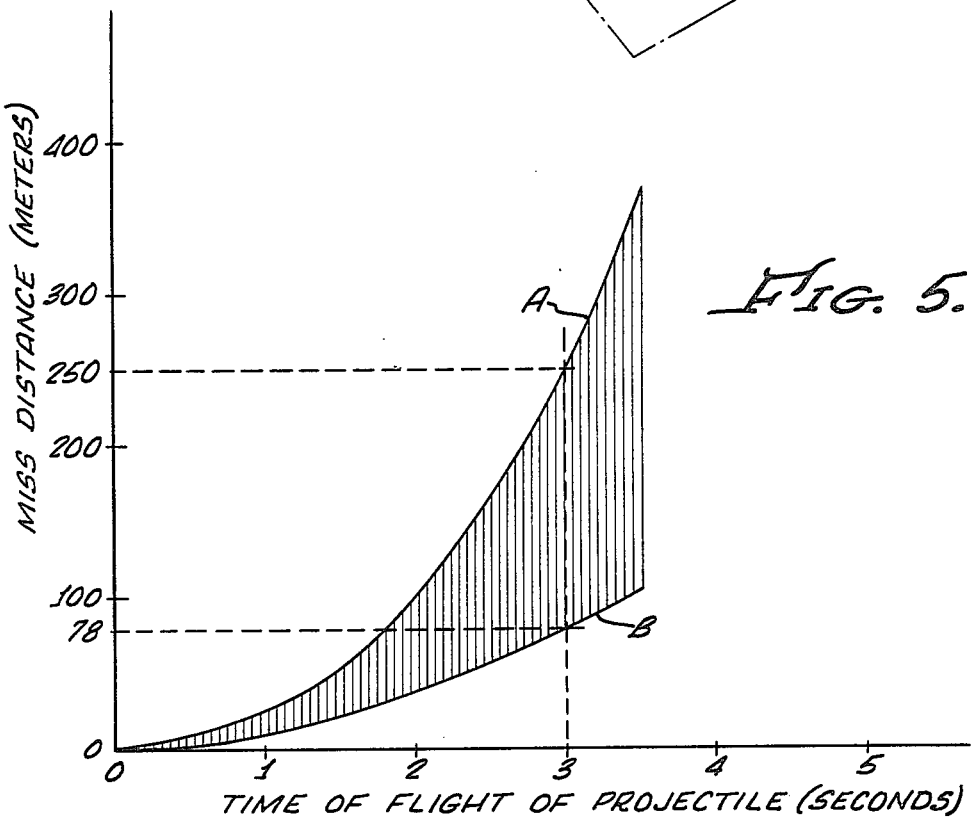
FIG. 5.

ANTIAIRCRAFT WEAPONS SYSTEM FIRE CONTROL APPARATUS

This invention relates generally to antiaircraft gunfire control systems, and more specifically to apparatus for predicting the flight path of maneuvering target aircraft.

Typical antiaircraft weapons systems include ranging and tracking means for acquiring target aircraft and monitoring their movement, a fire control system, and gun moving or laying means for directing a gun or guns along a projected target aircraft intercept path in response to signals from the fire control system. Ordinarily, a fire control system includes a computer for continuously calculating, from inputs from the ranging and tracking means and also from other inputted information, such as ballistics of the gun projectiles, a sequence of projected aircraft-gun projectile intercept positions. In more sophisticated fire control systems, various correction factors, for example, wind velocity or variation of projectile ballistic path with angle of elevation, may be supplied to, and be acted on by, the computer in calculating these projected intercept positions.

Conventional, ballistic type antiaircraft gun projectiles, however, have finite times of flight from gun to target, during which they receive no guidance from the ground. To enable hitting a moving target, assumptions must, therefore, be provided the fire control computer regarding what the target aircraft is likely to do during the unguided time of projectile flight.

Most preexisting fire control systems, exemplified by that described in U.S. Pat. No. 3,845,276 by Kendy et al, operate upon the assumption that the target aircraft flight path, during the time of projectile flight, will be a linear, constant speed extrapolation of its speed and heading at the instant of firing, as calculated by the computer from information received from the ranging and tracking means just prior to firing.

Such systems providing straight line extrapolations have generally proved more accurate than other heretofore available systems which have attempted to extrapolate or fit a projected curvilinear flight path to the measured positions, simply because position measurement errors tend to influence a projected curved flight path more than a projected straight line flight path. Nevertheless, straight line, constant speed extrapolations cannot accurately predict the flight path of maneuvering target aircraft and low hit and kill rates against such aircraft have been the general rule.

This is because in typical engagements, attacking aircraft go through the maneuvering process of attaining proper attitude for attacking ground targets and then evading antiaircraft gun fire. Thus, when firing at such aircraft, the assumption of a linear, constant speed aircraft flight path introduces a large inaccuracy in the fire control system. For while the computer directs the gun to fire along a straight line extrapolation of the aircraft attack path, a maneuvering aircraft, in fact, deviates greatly from this extrapolation, with the distance between the actual position of the maneuvering aircraft and the position calculated by the computer — the projectile miss distance — increasing as the projectile time of flight increases. Current fire control systems cannot accommodate a maneuver by a target aircraft since they use only a recent history of observed target aircraft position and speed as a basis for predicting the future flight path and calculating fire control solutions.

In accordance with this invention, gun fire control apparatus in an antiaircraft weapons system having at least one projectile firing gun, target aircraft tracking and ranging means having electrical output signals corresponding to target aircraft position and range and signal responsive gun laying means for aiming the gun, includes load factor inputting means for enabling selective, manual generation of electrical signals corresponding to estimated target aircraft maneuver load factors and roll angle inputting means for enabling selective, manual generation of electrical signals corresponding to estimated target aircraft roll angles. Additionally included are fire control computer means connected for receiving the electrical signals corresponding to target aircraft position and range and to the electrical signals corresponding to the estimated target aircraft maneuver load factors and roll angles. In response to the electrical signals the fire control computer means calculates a progression of target aircraft-gun projectile intercept points and supplies electrical controlling signals corresponding thereto to the gun laying means.

More specifically, the fire control computer means includes maneuver correction means, responsive to the tracking and ranging means and the electrical signals corresponding to estimated target aircraft maneuver load factors and roll angles, for calculating a correction to the predicted progression of future aircraft position, manual switch means in operative relationship with the roll factor and roll angle inputting means for selectively activating the maneuver correction means, and iteration means, in operative relationship with the switch means, the linear extrapolation means and the maneuver correction means, for calculating a progression of corrected aircraft projectile intercept positions and for supplying electrical controlling signals corresponding thereto to the gun laying means.

This invention achieves a very significant improvement in aircraft flight path prediction by utilizing more input information concerning the likely target aircraft future flight path than prior fire control systems. This additional information includes the inputs of aircraft roll angle and aircraft load factor (often called aircraft "g"). The roll angle is observed visually, estimated and entered in the fire control computer via manual means. Similarly, the aircraft load factor is observed visually, estimated and entered into the fire control computer via manual means. These inputs provide a much earlier indication of the onset of an aircraft maneuver than was heretofore possible by other systems employing only a history of the aircraft flight path.

Other advantages and features of the invention will appear from the following description when considered in connection with the accompanying drawings, in which:

FIG. 1 is an overall pictorial view of the apparatus of this invention;

FIG. 2 is a perspective view of a command console showing manual means for inputting estimated magnitudes of aircraft maneuvers;

Figure 7:
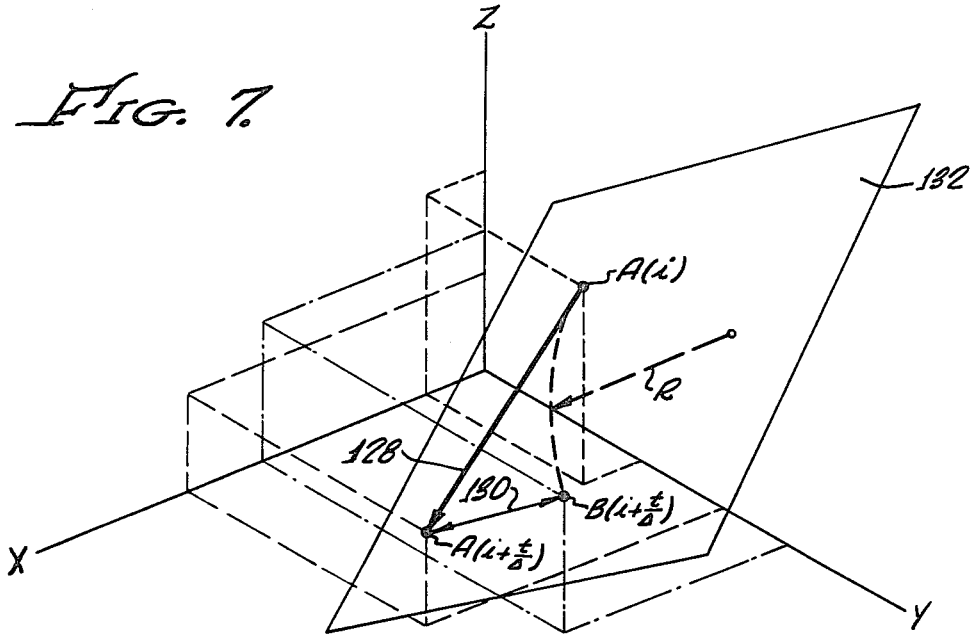
Figure 6:
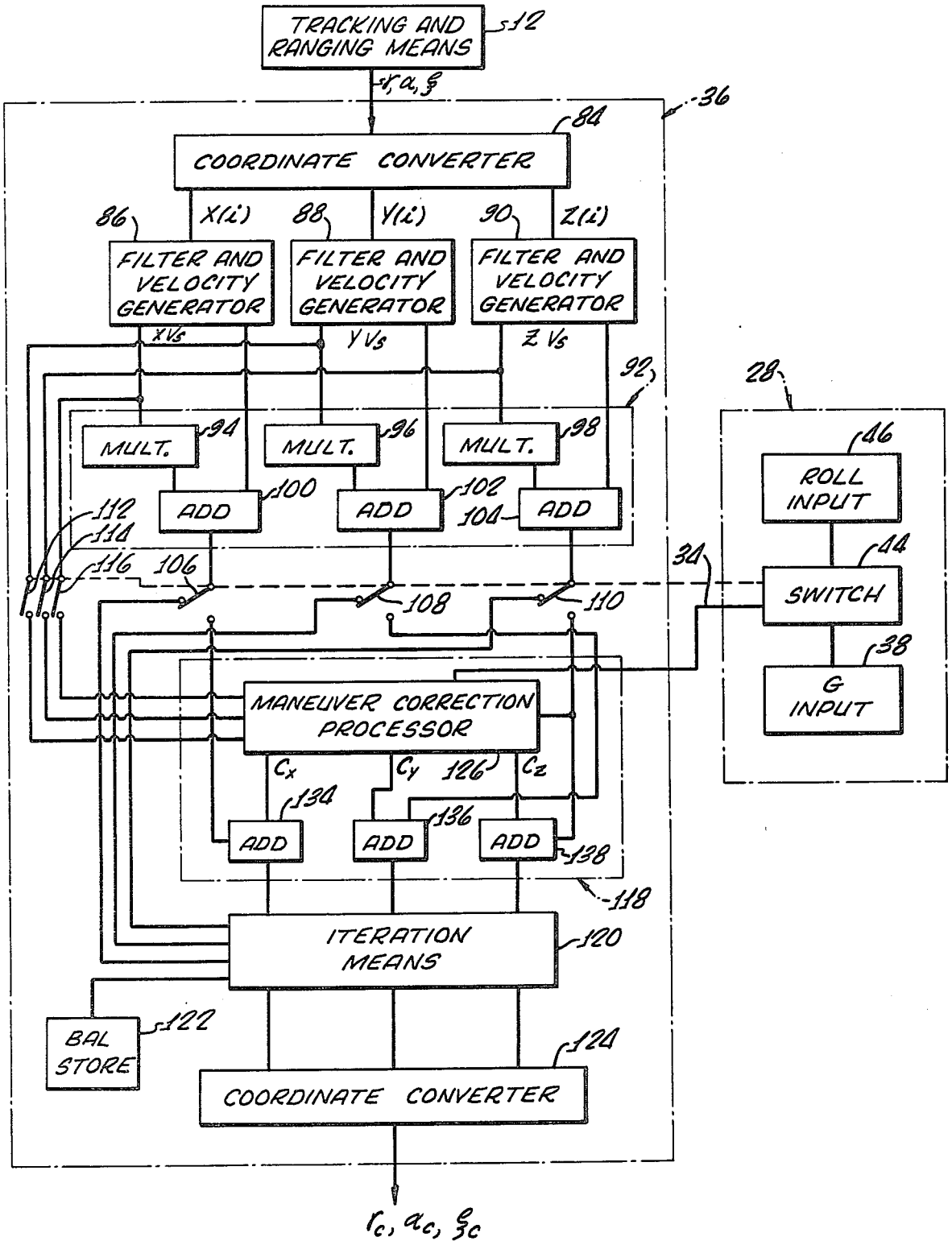

FIG. 4 diagrams various specific maneuvers by a maneuvering aircraft;

FIG. 5 is a plot of miss distance as a function of time for a gun firing a projectile against a maneuvering aircraft;

FIG. 6 is a logic block diagram of the automatic fire control and manual input means;

FIG. 7 is a geometric illustration of an aircraft maneuver correction; and

Figure 8:
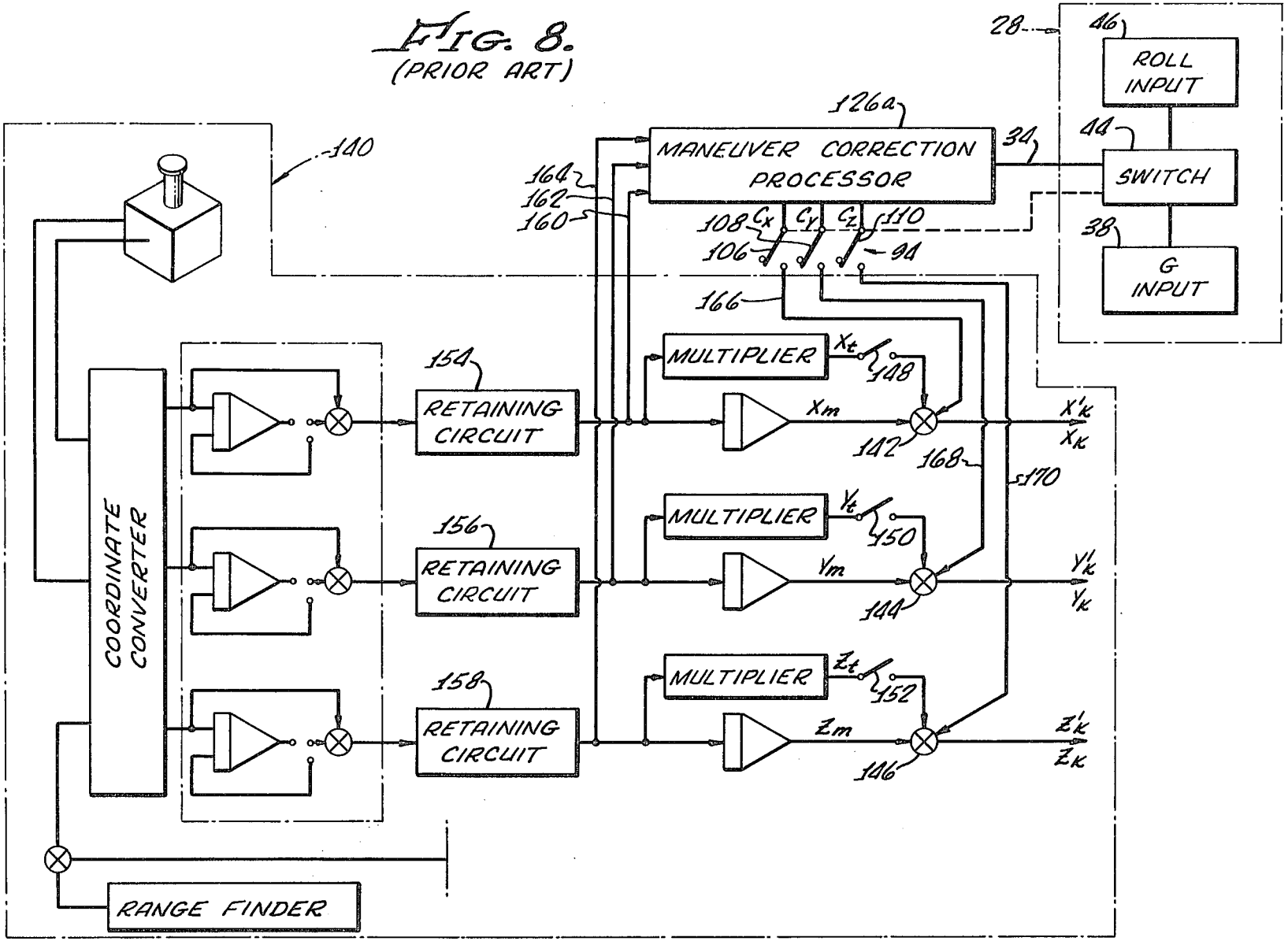
FIG. 8. (PRIOR ART)

FIG. 8 is a block diagram of a prior art fire control system showing incorporation of apparatus according to this invention.

Referring now to the drawings, FIG. 1 schematically diagrams major portions of an antiaircraft weapon system 10 in accordance with this invention. A tracking and ranging portion 12 of the weapon system 10 includes a manually operated optical sight 14 and a manually directed range finder 16. The range finder 16 may utilize a laser and is adapted to measure the distance to a target aircraft 18 many times per second. Both the optical sight 14 and the range finder 16 provide electrical output signals corresponding respectively to the target aircraft position and range.

A weapons system gun (or guns) 20 includes conventional azimuthal and elevational laying means 22 and 24, respectively, both of which are responsive to fire control output signals (as described below) for aiming the gun toward the target aircraft 18. A common power supply 26 furnishes the necessary power to all portions of the system 10.

In order to provide additional target aircraft information necessary for assuring a high hit and kill probability, a gun commander console 28, shown in FIG. 2, and hereinafter more particularly described, contains both load factor inputting means 30 for enabling selective, manual generation of electrical signals corresponding to estimated target aircraft maneuver load factors and roll angle inputting means 32 for enabling selective, manual generation of electrical signals corresponding to estimated target aircraft roll angles.

The load, or "g" factor, of an aircraft is the total force exerted on the aircraft and is a vectoral sum of both gravitational force and the centrifugal force due to maneuvering. The magnitude of the load factor corresponds, as hereinafter described, to a radius of curvature which defines a target aircraft flight path at a given speed. The roll angle of an aircraft is the angle between the wings of the aircraft and a horizontal line passing transversely through the aircraft fuselage.

The console 28, which may be fixed or portable, is connected by a cable 34 to fire control computer means, 36. Such means 36 is additionally connected for receiving electrical signals corresponding to target aircraft position and range from the tracking and ranging portion 12. From the signals thus received, the computer means 36 calculates a series or progression of target aircraft-gun projectile intercept points or positions, and supplies electrical controlling signals corresponding thereto to the gun laying means 22 and 24 for causing aiming of the gun 20.

Referring now to FIG. 2, the load factor inputting means 30 includes a turnable load factor control knob 38, identified as "G", which is connected, for example, to a conventional single turn potentiometer or multi-position switch, not shown. This enables generation and transmission to the fire control computer means 36 of an electrical signal corresponding to the selected position of the "G" control knob 38 with respect to a calibrated scale 40 on a console face 42, when a manually operated input switch 44 is activated.

The input switch 44 is preferably a multi-pole switch connected in electrical series with the potentiometer or switch associated with the "G" control knob 38 and, when manually depressed, closes a circuit to the fire control computer means 36. Since the expected range of aircraft load factors is from about 0 to a maximum of 9 g's the scale 40 is accordingly calibrated.

Similarly, the roll angle inputting means 32 includes a turnable control knob 46, identified as "Roll". The roll control knob 46 is also preferably connected to a conventional single turn potentiometer or multi-position switch, not shown, such that for each selected position of the control knob 46, with respect to an associated calibrated scale 48 on the console face 42, a corresponding electrical signal is also transmitted to the fire control computer means 36 when the manual switch 44 is depressed. In order to maintain separation between the electrical signals corresponding to the aircraft load factor and roll angle, the switch 44 has one pole for interconnecting with the fire control computing means 36 the potentiometer associated with the load factor control knob 38 and another pole for so interconnecting the potentiometer associated with the roll angle control knob 46.

The expected range of roll angle through the course of an attacking aircraft maneuver is between minus 90 degrees and plus 90 degrees, the scale 48 being calibrated accordingly. The estimated future direction of aircraft roll movement is indicated by the plus or minus sign of the aircraft roll angle.

Finally, a power switch 50 is provided in the console 28 to disconnect the load factor inputting means 30 and the roll angle inputting means 32 when the console is not in use.

By use of the gun commander console 28, aircraft maneuvering information is selectively introduced into the fire control computing means 36 at the initiation of an aircraft maneuver and continuously thereafter. This maneuvering information is, as noted above, in the form of load factor and roll angle estimates, which are inputted into the fire control computer means 36 by the means 30 and 32, respectively, for each phase of an aircraft attack, as described below.

The basis for these load factor and roll factor estimates is visual observation of the aircraft maneuver by an operator as well as prior knowledge, by the operator, of attack tactics of target aircraft. In addition, during an engagement, observed relative misses of tracer-type projectiles may be used to improve the load factor and roll angle estimates.

Figure 3:
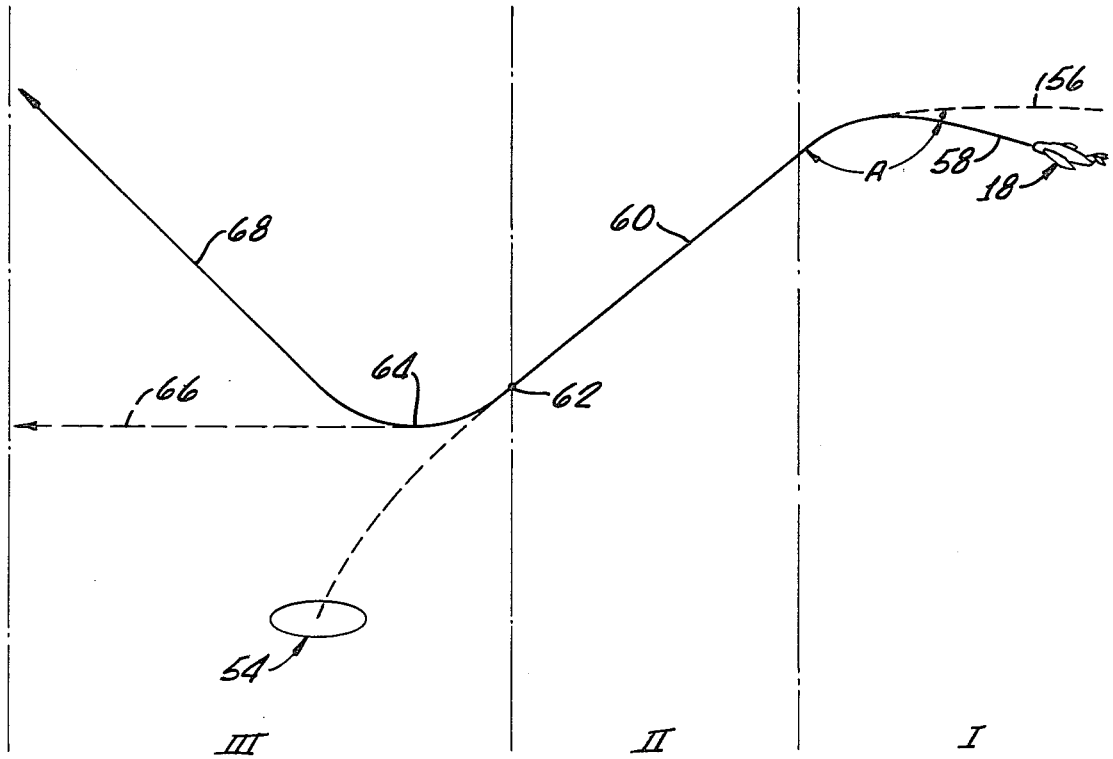
FIG. 3 is a diagram of typical weapon delivery maneuvers by an attacking aircraft.

Prior experience has taught that there exists a relatively narrow range of feasible load factors and roll angles during each of several, well defined phases of an aircraft attack. As an illustration, a typical jet fighter dive bombing attack, as depicted in FIG. 3, can be described in three phases which are designated by I, II and III. This particular attack sequence complies both with Air Force Training Manuals AFM 55-4 for the F-4 fighter and AFM 55-77 for the A-7 attack aircraft.

Phase I, as shown, represents a roll-in by the target aircraft 18, which is flying at a cruise speed of about 155 to 230 m/sec (300 to 450 knots) and at an altitude from about 1219m to 3658m (4,000 to 12,000 feet), just as aircraft comes abreast of a ground target 54. The Phase I roll-in uses a bank or roll of 1 to 2 g's to turn through 60 to 120 degrees (angle A, FIG. 3) of heading from an initial aircraft flight path 56 or 58 to a dive flight path 60. The aircraft 18 simultaneously dives to achieve about a 30 to 45 degree diving angle (line 60, Phase II).

In the Phase II dive flight path 60, the aircraft 18 is assumed to maintain a zero roll attitude to adjust the dive angle and stabilize the target 58 in the aircraft's bomb sight before bomb release at a point 62.

Following bomb release at point 62, and during Phase III of the attack, the aircraft 18 performs a 3 to 5 g pull-up from the dive, in a nearly zero roll attitude, until the aircraft nose passes through a horizontal plane 64. The aircraft 18 then either escapes in a level flight path 66 or continues pulling up to establish a climbing path 68. After the pull-up to the horizontal plane 64, the aircraft typically performs evasive maneuvers, such as "jinking" or weaving, at load factors of 2 to 3 g's. Maneuvering load factors pulled along exit paths are ordinarily less than those during the initial pull-up to the horizontal plane 64 to avoid excessive speed loss during climbout.

All maneuvers performed by an attacking aircraft are generally coordinated so that a lift force vector 70 (FIG. 4) is always perpendicular to a plane 72 defined by the wings of the aircraft 18. Under this condition, the bank or roll angle provides a direct indication of the immediate future direction in which the aircraft will fly. FIG. 4*a* depicts the aircraft 18 banking in level flight, with a roll angle B and a lift vector 70 pointing in the direction of a radius of curvature R of a circular flight path 74. However, a level turn by an attacking aircraft is rare. More commonly, an attack aircraft will either dive or climb while performing a roll. This usually occurs in Phase I of the attack, as shown in FIG. 4*b* where R′ is the radius of a resultant curved flight path 76. A wings-level pull-up shown in FIG. 4*c* is typically performed at the end of attack Phase II, the curvature R″ of an aircraft flight path 78 being in a vertical plane.

Inputting of the load factor and the roll angles of the aircraft at the initiation of a maneuver by an attacking aircraft is particularly advantageous because, as is well known, aircraft experience a finite aerodynamic lag between the time attitude is changed and the onset of an actual change in the flight path. Hence, maneuvering inputs to the computer at the instant an aircraft attitude change is observed provide the computer with information regarding the probable future flight path of the aircraft before the aircraft actually changes its flight direction. Because such maneuvering inputs anticipate the actual turn by the aircraft, the fire control computer means 36 can be adapted to compensate for human response in manipulating the manual input controls.

Typical operation of the control console 28 in association with the fire control computer means 36 is as follows: A gunner manually aims the optical sight 14 at the target aircraft 18 as soon as it is seen and continues to track the aircraft for the duration of the engagement. Upon acquiring and beginning to track the target aircraft 18, the gunner activates the range finder 16 to measure the aircraft's range. Concurrently with such tracking and ranging, a second gunner or gun commander watches the target aircraft 18 for maneuvers. Upon detecting a change in aircraft roll angle, for example, the gun commander turns the console roll angle input knob 46 to the appropriate scale position corresponding to the observed target roll angle.

Alternatively, the gun commander may preset the load factor and/or roll angle input knobs 38, 46 to levels anticipated as characteristic of the next attack phase. For instance, prior to initial roll-in (Phase I, FIG. 3) the commander may set the load factor input knob 38 to about 1½ g's, since the load factor is expected, from experience, to be about 1 to 2 g's. Or, after the roll-in phase has been completed, the commander may then set the knob 38 to about 4 g's, anticipating the Phase III pull-up load factor will be between 3 and 4 g's.

Setting the load factor or roll angle input knobs 38 and 46 does not, by itself, initiate any maneuvering input to the fire control computer means 36. The onset of a maneuver, as defined as an observed deviation from a straight flight path, is signaled to the computer means 36 only when the gun commander depresses the manual input switch 44. The end of a maneuver, that is, when the target aircraft resumes a straight flight path, is signaled when the commander releases the input switch 44. During a target aircraft maneuver, observed or estimated roll angle and load factor values may be adjusted, by appropriately positioning the console knobs 38, 46 to match observed changes in the maneuver, to correct previously set estimates, or on the basis of observed tracer projectile paths.

Accurate correction to generally conventional, constant speed, linear extrapolation of target aircraft flight path during the time of flight of a projectile is essential, particularly at long range, if a high target hit and kill probability is to be achieved.

To illustrate the inadequacy of constant speed, linear aircraft flight path extrapolations in predicting aircraft-gun projectile intercept points, FIG. 5 plots calculated target miss distance as a function of projectile time of flight for a typical range of Phase I and II maneuvers when only such an extrapolation is used. Miss distance, as used herein, is defined as the distance between the actual position of an aircraft performing a maneuver and the position the aircraft would be at had it continued a straight line, constant speed flight; it is the amount by which a fired projectile will miss a maneuvering aircraft when only a straight line, constant speed extrapolation, without compensation for maneuvering, is used to calculate projected flight paths.

From curve A, it is thus seen that for a relatively high "g" maneuver, in which the target aircraft is traveling at about 240m/sec (466 knots) and is beginning an 80 degree roll maneuver at 5.7 g's load when the projectile is fired, (curve A, FIG. 5) the miss distance is about 250m, assuming a typical projectile time of flight of approximately 3 seconds (corresponding to a target range of about 1500–2000 meters) and from curve B, which represents only a moderately low "g" maneuver in which the target aircraft, traveling at about 240m/s make a 2 g maneuver with a 60 degree roll angle, the miss distance is seen to be about 78 meters for a 3 second projectile time of flight. The shaded region between curves A and B, which represents, for various durations of projectile flight, the approximate range of expected miss distances for Phase I and Phase III attack maneuvers using only straight line, constant speed target path extrapolation, clearly shows that this type of extrapolation yields completely unsatisfactory results in terms of predicting aircraft-gun projectile intercept points.

Referring to FIG. 6, which represents a logic block diagram of the fire control system, the fire control computing means 36 continuously receives target aircraft data from the tracking and ranging means 12, in the form of range, r, azimuthal angle, $\alpha$, and elevation angle, $\xi$, the angles being in polar coordinates. Such data points are first transformed by the fire control computer means 36 to rectilinear coordinates X, Y and Z by a conventional coordinate converter 84, exemplified, for example, in U.S. Pat. No. 3,766,826 by H. M. A. Salomonsson.

Next, the X, Y and Z data from the coordinate converter 84 is smoothed or averaged, to yield coordinates Xs, Ys and Zs which are used to obtain target aircraft component velocities ${}_xV_s$, ${}_yV_s$ and ${}_zV_s$. This is accomplished by X, Y and Z axis filter and velocity generators 86, 88 and 90, respectively. The smoothing may be a simple average of several of the latest positional coordinates. The velocity generator, which may include an integrator, may be a conventional type such as described in above cited Salomonsson patent.

Equations utilized in the filter and velocity generators 86, 88 and 90 are:

$$X_s(i) = X_p(i) + a[X(i) - X_p(i)] \quad (1)$$

$${}_xV_s(i) = {}_xV_s(i-1) + b/\Delta[X(i) - X_p(i)] \quad (2)$$

$$X_p(i) = X_s(i) + {}_xV_s(i) \quad (3)$$

where $i = i^{th}$ data update $\Delta$ = sampling interval a, b = smoothing constants $X_s$, ${}_xV_s$ = smoothed position and velocity in the x direction, and $X_p(i)$ = predicted X position (1 interval ahead)

Analagous equations are used for the Y and Z components.

Velocity and position data from the filter and velocity generators 86, 88 and 90 is directed to a linear extrapolation means 92 which calculates an aircraft future position in X, Y and Z coordinates, using separate X, Y and Z axis multipliers 94, 96 and 98 and adders 100, 102 and 104 for each coordinate, according to the equation:

$$X_1(i + t/\Delta) = X_s(i) + t\,{}_xV_s(i) \quad (4)$$

Where:

$X_1$ = linearly extrapolated target position in the X coordinate, and t = number of seconds of future path to be extrapolated.

Similar equations hold for $Y_1$ and Z.

Separate X, Y and Z axis, double pole switch contacts 106, 108 and 110 and normally open contacts 112, 114 and 116 of the manual switch 44, serve to bypass or disconnect a maneuver correction means 118 when the switch is not depressed so that only a constant velocity, linear path extrapolation is calculated (FIG. 6 shows the switch 44 not depressed). When the switch 44 is depressed, the correction means 118 is connected in series, through the contacts 106–116, with the extrapolation means 92 and an iteration means 120, for calculating a corrected fire control solution, that is, a corrected progression of extrapolated or predicted future target aircraft-gun projectile intercept positions based on adding a maneuvering correction to the constant speed, linear path approximation.

When the switch 44 is not depressed, thus leaving the correction means 118 out of the system, the iteration means 120 calculates a fire control solution based only on the constant speed, linear extrapolation of the aircraft flight path given by $X_1$, $Y_1$ and $Z_1$, and as is sufficient if the target aircraft 18 is not maneuvering. Such a maneuver-uncorrected fire control solution is calculated by iterating the value of t, the time period over which the target aircraft path is extrapolated, until the projectile time of flight, $t_f$, to the future aircraft position (at time t) is equal to t. Thus, t is iterated until the following generalized equation is satisfied:

$$t_f[X_1(i+t/\Delta), Y_1(i+t/\Delta), Z_1(i+t/\Delta)] = t \quad (5)$$

The function $t_f$, which may be different for various types of guns and projectiles, is determined and stored in a ballistic storage register 122 such that it is accessible to the iteration means 120.

The value of t which solves Equation 5 (above) is designated t*, coordinates of the predicted aircraft projectile positions thus being equal to:

$$X_1(i + t^*/\Delta),\ Y_1(i + t^*/\Delta),\ Z_1(i + t^*/\Delta) \quad (6)$$

Lastly, a second coordinate converter 124 translates these rectilinear coordinates (equation 6) back into polar coordinate $r_1$, $\alpha_1$, $\xi_1$ entered at the gun 20. Signals generated by the computer means 36 and corresponding to such polar coordinates, represent the final superelevation and lead pointing angle commands to the laying means 22 and 24 for training the gun 20 so that fired projectiles will interecept the target aircraft.

Ballistic corrections for wind, velocity ambient temperature, etc., may be provided by storing, in the register 122, sets of different functions $t_f$, each $t_f$ corresponding to a different condition of wind, temperature, etc.

Thus, when tracking or firing at non-maneuvering target aircraft (with the switch 44 open or with no inputs from the console 28) the weapon system 10 operates in a generally conventional manner.

However, when tracking or firing at a maneuvering target aircraft, an operator depresses the console switch 44 to activate the maneuver correction means 118, and input thereinto an estimated load factor signal corresponding to a selected setting of the manual control knob 38 (in n g's) and an estimated roll angle signal corresponding to a selected setting of the control knob 46 (in $\pm\phi$ degrees). This causes a maneuvering correction, which may be curvilinear, to be applied to the constant velocity straight line extrapolation of the target aircraft path in order that a more accurate fire control solution is attained.

To this end, the maneuver correction means 118 includes a processor 126 which calculates the magnitude of the maneuver correction perpendicular to the aircraft velocity vector. FIG. 7 illustrates a maneuver correction in an X, Y, Z coordinate system, A(i) being the position of the target aircraft at the beginning of the maneuver, A (i + t/Δ) being the target aircraft position at a later time, t, if no maneuver were performed and B (i + t/Δ) being the target aircraft position if the maneuver is performed. A line 128 connecting the positions A(i) and A(i + t/Δ) represents the initial aircraft velocity vector; whereas, the magnitude of the maneuver correction is indicated by a double headed arrow 130.

The basis of the processor 126 calculations, for example and as shown, may be an assumed circular aircraft flight path having a radius, R, perpendicular to the aircraft velocity vector (line 128) in a plane 132 of maneuver (FIG. 7). The mathematical representation of the maneuver correction vector, $\overrightarrow{C(t, \phi, n)}$, is given by:

$$C(t, \phi, n) = 2V_s^2/n_m g \sin^2[g n_m t/2V_s] \quad (7)$$

Where $$V_s = \sqrt{{}_xV_s^2 + {}_yV_s^2 + {}_zV_s^2}$$

$$n_m = \sqrt{n^2 \sin^2\phi + [n\cos\phi - 1]^2}$$

The plane 132 of the maneuver rotates about the aircraft flight vector 128 and the angle, $\alpha$, this plane makes with the vertical axis Z, is then given by:

$$\alpha = \tan^{-1} [n \cos \phi - 1/n \sin \phi] \quad (8)$$

The maneuver correction vector $\overrightarrow{C(t,\phi,n)}$ is next resolved, by the processor 126, into rectangular coordinates $C_X(t,\phi,n)$, $C_y(t,\phi,n)$ and $C_Z(t,\phi,n)$ X, Y, and Z coordinate adders 134, 136 and 138 (FIG. 6) combine (when the switch 44 is closed) these maneuver correction components with the linearly extrapolated target position X,Y,Z, from the adders 100, 102 and 104, according to the following equation:

$$X_m(i + t/\Delta) = X_1(i + t/\Delta) + C_x(t,\phi,n) \quad (9)$$

Wherein $X_m$ is the maneuver corrected extrapolation of target position in the X coordinates and $C_x(t,\phi,n)$ represents the X component of the deviation from linear motion.

Similar equations hold for $Y_m$ and $Z_m$.

This curvilinear corrected position of the target aircraft is next passed to the iteration means 120 for determination of the solution by means of the functional equation:

$$t_f[X_m(i + t/\Delta), Y_m(i + t/\Delta), Z_m(i + t/\Delta)] = t \quad (10)$$

By iteration, as described above in connection with equation (5), the coordinates of the predicted target aircraft-projectile intercept coordinate positions, as modified with maneuvering inputs, become:

$$X_m(i + t^*/\Delta), Y_m(i + t^*/\Delta), Z_m(i + t^*/\Delta) \quad (11)$$

These coordinates from equation (11) are next translated by the coordinate converter 124 into equivalent polar coordinates $r_c$, $\alpha_c$, $\xi_c$, of which $\alpha_c$ and $\xi_c$ represents the final command superelevation and azimuthal angles necessary for projectiles fired by the gun 20 to hit the maneuvering target aircraft 18.

It is emphasized that the fire control means 36 calculates a series of such intercept positions or points in a substantially continuous manner, as the maneuvering target aircraft is tracked. The gun 20 is likewise continuously trained by the laying means 22, 24 to lead the aircraft by the calculated amount so that any time firing is initiated a high target hit and kill probability exists.

While the calculations hereinabove described in conjunction with the logic block diagram of FIG. 6 may be performed by a single digital or analog computer or a combination thereof with appropriate analog/digital converters all well known in the art, the logic blocks representing the functions to be performed, including the extrapolation means 92, the maneuver correction processor 126 and the iteration means 120, may preferably each be separate computing elements in order to reduce computer cost and provide for faster calculation as is well known in the art.

Before considering a variation of this embodiment, which is particularly adapted for incorporation into a preexisting fire control systems, it should be noted that such preexisting systems may vary in the type of computer and algorithms used to calculate the target aircraft-projectile intercept positions. Thus, for various preexisting systems, the maneuver correction (Equation 7) may have to be introduced at a different point in the apparatus and at a different step in the data processing sequence. The proper point and step to introduce the maneuver correction is dictated by the configuration of the preexisting systems, and can readily be determined by a person skilled in the art of fire control computers.

As an illustration, with no limitations implied or intended, and referring to FIG. 8, the U.S. Pat. No. 3,766,826 of H. M. A. Salomansson describes a fire control system 140 which calculates $X_m$, $Y_m$ and $Z_m$, in rectilinear coordinates.

Briefly described and using the symbolism and terminology of the above cited patent, the Salomansson system 140 accomodates linear motion of a target aircraft by calculating a set of aim-off correction signals $X_t$, $Y_t$ and $Z_t$ which are added to otherwise controlling signals $X_m$, $Y_m$ and $Z_m$ by X, Y and Z coordinate axis adders 142, 144 and 146 when switch contacts 148, 150 and 152 are closed. The resulting signals $X_k$, $Y_k$, $Z_k$ actually control training of an associated gun or guns (not shown).

The Salomansson (or similar) system 140 can be modified to provide maneuvering corrections by the addition of a maneuver correction processor **126*a* (similar to the above described processor 126) and the console 28. This may be accomplished by connecting the velocity output $V_x$, $V_y$, $V_x$, of Salomansson X, Y and Z coordinate axis retaining circuits 154, 156 and 158 to the processor 126*a*, through X, Y and Z axes electrical wires 160, 162 and 164 (FIG. 8), and connecting the processor 126*a* to the Salomansson adders 142, 144 and 146 via X, Y and Z axes electrical wires 166, 168 and 170 though contacts 106, 108 and 110 respectively of the switch 44**.

The processor **126*a* accepts roll and g signals from the control knobs 38 and 46 on the console 28 when the switch 44 is closed, in order to enable calculating of a maneuver correction $C_x$, $C_y$, $C_z$ as above described. The adders 142, 144 and 146** then combine the controlling signals $X_m$, $Y_m$ and $Z_m$ with both the aim-off correction signals $X_t$, $Y_t$ and $Z_t$ and the maneuver correction signals $C_x$, $C_y$, $C_z$ to yield new signals $X_k'$, $Y_k'$, $Z_k'$ for aiming the gun.

Other preexisting fire control systems can be modified in a similar or analogous manner.

Although there has been described hereinabove a particular arrangement of fire control apparatus for the purpose of illustrating the manner in which the invention may be used to advantage, it will be appreciated that the invention is not limited thereto. Accordingly, any and all modifications, variations or equivalent arrangements which may occur to those skilled in the art, should be considered to be within the scope of the invention as defined in the appended claims.

What is claimed is:

1. In an antiaircraft weapons system including at least one projectile firing gun, target aircraft tracking and ranging means having electrical output signals corresponding to target aircraft position and range and signal responsive gun laying means for aiming the gun, gun fire control apparatus, comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles; and (c) fire control computer means connected for receiving the electrical signals corresponding to target aircraft position and range and to the electrical signals corresponding to the estimated target aircraft maneuver load factors and roll angles and, in response thereto, for calculating a progression of target aircraft-gun projectile intercept points and for supplying electrical controlling signals corresponding thereto to the gun laying means.

2. In an antiaircraft weapons system including at least one projectile firing gun, target aircraft tracking and ranging means having electrical output signals corresponding to target aircraft position and range and signal responsive gun laying means for aiming the gun, gun fire control apparatus, comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles; and (c) fire control computer means connected for receiving the electrical signals corresponding to target aircraft position and range and to the electrical signals corresponding to the estimated target aircraft maneuver load factors and roll angles and, responsive to the electrical signals corresponding to the target aircraft position and range for calculating a progression of target aircraft-gun projectile intercept points and being additionally responsive to the electrical signals corresponding to estimated target aircraft maneuver load factors and roll angles for calculating a correction to be applied to said progression of intercept points, and for supplying, to the gun laying means, electrical controlling signals corresponding to the corrected progression of intercept points.

3. In an antiaircraft weapons system including at least one projectile firing gun, target aircraft tracking and ranging means having electrical output signals corresponding to target aircraft position and range and signal responsive gun laying means for aiming the gun, gun fire control apparatus, comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles; and (c) fire control computer means including:

extrapolation means responsive to the electrical signals corresponding to target aircraft position and range, for predicting a progression of future aircraft positions, maneuver correction means, responsive to the tracking and ranging means and the electrical signals corresponding to estimated target aircraft maneuver load factors and roll angles for calculating a correction to the predicted progression of future aircraft position, and iterating means, in operative relationship with the linear extrapolation means and the maneuver correction means, for calculating a progression of corrected aircraft-gun projectile intercept positions and for supplying electrical controlling signals corresponding thereto to the gun laying means.

4. The apparatus of claim 3, wherein the maneuver correction means employs an assumption of curvilinear aircraft flight in the calculation of the correction to the predicted progression of future aircraft positions.

5. In an antiaircraft weapons system including at least one projectile firing gun, target aircraft tracking and ranging means having electrical output signals corresponding to target aircraft position and range and signal responsive gun laying means for aiming the gun, gun fire control apparatus, comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles; and (c) fire control computer means including:

extrapolation means responsive to the electrical signals corresponding to target aircraft position and range and employing an assumption of linear, constant speed aircraft flight, for predicting a progression of future aircraft positions, maneuver correction means, responsive to the tracking and ranging means and the electrical signals corresponding to estimated target aircraft maneuver load factors and roll angles for calculating a correction to the predicted progression of future aircraft position, and iterating means, in operative relationship with the linear extrapolation means and the maneuver correction means, for calculating a progession of corrected aircraft-gun projectile intercept positions and for supplying electrical controlling signals corresponding thereto to the gun laying means.

6. In an antiaircraft weapons system including at least one projectile firing gun, target aircraft tracking and ranging means having electrical output signals corresponding to target aircraft position and range and signal responsive gun laying means for aiming the gun, gun fire control apparatus, comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles; and (c) fire control computer means including: extrapolation means responsive to the electrical signals corresponding to target aircraft position and range and employing an assumption of linear, constant speed aircraft flight, for predicting a progression of future aircraft positions, maneuver correction means, responsive to the tracking and ranging means and the electric signals corresponding to estimated target aircraft maneuver load factors and roll angles for calculating a correction to the predicted progression of future aircraft position, manual switch means in operative relationship with the roll factor and roll angle inputting means for selectively activating the maneuver correction means; and iterating means, in operative relationship with the switch means, the linear extrapolation means and the maneuver correction means, for calculating a progression of corrected aircraft projectile intercept positions and for supplying electrical controlling signals corresponding thereto to the gun laying means.

7. In an antiaircraft weapons system, including having at least one projectile firing gun, target tracking and ranging means and computer means for predicting, in response to output signals from the tracking and ranging means, progressive aircraft-gun projectile intercept positions, apparatus comprising:

(a) manually operated means for inputting, in electrical signal form, estimates of selected characteristics of target aircraft maneuvers into the computer means; and (b) maneuver correction means, responsive to the estimate inputting means and in operative relationship with the computer means for calculating and applying appropriate corrections to the predicted aircraft-projectile intercept positions.

8. The apparatus of claim 7, wherein the maneuver correction means applies an assumption of curvilinear aircraft flight in calculating the appropriate correction to the predicted aircraft-gun projectile positions.

9. In an antiaircraft weapons system, including at least one projectile firing gun target tracking and ranging means and computer means for calculating progressive aircraft-gun projectile intercept positions applying an assumption of linear, constant speed target aircraft flight, apparatus comprising:

(a) manually operated means for inputting, in electrical signal form, estimates of selected characteristics of target aircraft maneuvers into the computer means;

(b) maneuver correction means, responsive to the estimate inputting means and in operative relationship with the computer means, for calculating curvilinear corrections to the calculated aircraft-gun projectile intercept positions and combining said corrections with the calculated intercept positions upon command; and (c) manual switch means, in operative relationship with the manual means for selectively commanding the maneuver correction means to combine said corrections with the calculated intercept positions.

10. In antiaircraft weapons system including at least one projectile firing gun, target tracking and ranging means and computer means for calculating, in response to output signals from the tracking and ranging means, a progression of target aircraft-gun projectile intercept positions, applying an assumption of linear, constant speed target aircraft flight, apparatus comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles; and (c) maneuver correction means, responsive to the load factor and roll angle inputting means and in operative relationship with the computer means, for calculating and applying a curvilinear correction to the calculated target aircraft-gun projectile intercept positions.

11. In an antiaircraft weapons system including at least one projectile firing gun, manually operated tracking means, manually operated ranging means, computer means for calculating, in response to output signals from the tracking and ranging means, progressive target aircraft-gun projectile intercept positions, applying an assumption of linear, constant speed target aircraft flight, and training means for rotating, elevating and depressing the gun in response to output signals corresponding to the calculated intercept positions, apparatus comprising:

(a) load factor inputting means for enabling selective, manual generation of electrical signals corresponding to estimated target aircraft maneuver load factors;

(b) roll angle inputting means for enabling selective, manual generation of electrical signals corresponding to estimated target aircraft roll angles;

(c) maneuver correction means, responsive to the electrical signals corresponding to estimated target aircraft load factors and roll angles and in operative relationship with the computer means, for calculating a correction to the calculated aircraft projectile intercept positions applying an assumption of circular aircraft flight, and combining said correction with the calculated intercept positions upon command; and (d) manual switch means, in operative relationship with the load factor and roll angle means for commanding the maneuver correction means to combine the correction with the calculated intercept positions.

12. In an antiaircraft weapons system for shooting at a target aircraft, the antiaircraft weapons system having a projectile firing gun, gun laying means for aiming the gun, and a fire control system which includes tracking means for following the position of the target aircraft and a computer responsive to the tracking means for calculating projected intercept points of projectiles with the target aircraft and accordingly controlling the gun laying means to lead the aircraft in order to hit it in its expected future position, fire control apparatus comprising:

a manually operated means for initiating input signals to the computer relative to one or more visually observable early indications of anticipated target aircraft maneuvering, which input signals include information relative to the visually observed roll attitute of the target aircraft; and computer means, responsive to said input signals, for integrating the anticipated target aircraft maneuvering information, as indicated by said signals, into the calculation of said projected intercept points.

13. The antiaircraft weapons system of claim 12, wherein the manually operated means for initiating input signals to the computer relative to one or more visually observable early indications of anticipated target aircraft maneuvering includes means for initiating input signals which includes information relative to the visually observed pitch of the target aircraft.

14. The antiaircraft weapons system of claim 12 wherein the manually operated means for initiating input signals to the computer relative to one or more visually observed early indications of anticipated target aircraft maneuvering includes means for preselecting anticipated target aircraft maneuvering, and means for withholding or addressing said computer with said input signal information.

* * * * *

UNITED STATES PATENT AND TRADEMARK OFFICE

CERTIFICATE OF CORRECTION

PATENT NO. : 4,146,780

DATED : March 27, 1979

INVENTOR(S) : Pierre M. Sprey

It is certified that error appears in the above-identified patent and that said Letters Patent are hereby corrected as shown below:

In column 8, line 62, replace: $C(t,\phi,n) = 2V_s^2/n_m g \sin^2 [gn_m t/2V_s]$ with : $C(t,\phi,n) = [2V_s^2/n_m g] \sin^2 [gn_m t/2V_s]$ In column 9, line 5, replace: $\alpha = \tan^{-1} [n \cos \phi - 1/n \sin \phi]$ with : $\alpha = \tan^{-1} [(n \cos \phi - 1)/n \sin \phi]$ In column 10, line 26, replace: the second occurring $V_x$ with : $V_z$ Signed and Sealed this

*Fifth* Day of *February 1980*

[SEAL]

*Attest:*

SIDNEY A. DIAMOND

*Attesting Officer*

*Commissioner of Patents and Trademarks*